US006427392B1

(12) United States Patent
Platts

(10) Patent No.: US 6,427,392 B1
(45) Date of Patent: Aug. 6, 2002

(54) METHOD OF ROOF REINFORCEMENT AGAINST HURRICANES

(76) Inventor: Robert E. Platts, 12 Bedford Crescent, Ottawa, Ontario (CA), K1K 0E4

( * ) Notice: Subject to any disclaimer, the term of this patent is extended or adjusted under 35 U.S.C. 154(b) by 0 days.

(21) Appl. No.: 09/655,831

(22) Filed: Sep. 6, 2000

(51) Int. Cl.[7] ..... E04B 7/04

(52) U.S. Cl. ..... 52/92.2; 52/93.1; 52/712; 52/702

(58) Field of Search ..... 52/698, 23, 79.12, 52/92.2, 714, 707, 264, 712, 223.13, 167.1, 143, 741.3

(56) References Cited

U.S. PATENT DOCUMENTS

| | | | | | |
|---|---|---|---|---|---|
| 2,947,119 | A | * | 8/1960 | Puckett, Jr. | 50/466 |
| 3,000,145 | A | * | 9/1961 | Fine | 50/466 |
| 4,714,372 | A | | 12/1987 | Commins | 403/400 |
| 5,152,114 | A | * | 10/1992 | Beazley et al. | 52/264 |
| 5,319,896 | A | | 6/1994 | Winger | 52/23 |
| 5,335,470 | A | * | 8/1994 | Alvarez | 52/699 |
| 5,535,561 | A | * | 7/1996 | Schuyler | 52/223.13 |
| 5,560,156 | A | | 10/1996 | McDonald | 52/92.2 |
| 5,570,545 | A | | 11/1996 | Adams | 52/23 |
| 5,623,788 | A | | 4/1997 | Bimberg et al. | 52/23 |
| 5,640,822 | A | * | 6/1997 | Haswell | 52/712 |
| 5,699,639 | A | * | 12/1997 | Fernandez | 52/707 |
| 5,870,861 | A | * | 2/1999 | Gnaedinger | 52/93.1 |

* cited by examiner

*Primary Examiner*—Carl D. Friedman
*Assistant Examiner*—Basil Katcheves
(74) *Attorney, Agent, or Firm*—Ogilvy Renault; Wayne H. Yan; Max R. Wood

(57) ABSTRACT

The invention comprises the insertion of anchors into suitably located wall cavities, each anchor being suspended by cables extending up through the wall top and into the roof space; then making fast each anchor by the injection into the cavity above the anchor of a hardening, adhering liquid "plug" of sufficient size and strength, pressing down upon the anchor and strongly adhering to the confining internal surfaces of the cavity. Especially in cases where there are no wall cavities, or none readily accessible, the invention encompasses anchoring the roof to or through the exterior surfaces of suitably located walls by means of long vertical straps; these extend up through the ceiling sufficiently into the roof space, taking the place of the cavity anchors and cables. Since in either case the anchor points will usually be widely spaced with respect to the roof rafters or trusses above them, the invention includes the use of beams in the roof space so that each anchor can hold down a large area of roof. The invention is conceived particularly for retrofit of existing buildings, where it can be applied inconspicuously and with minimum disruption and cost. Primarily intended to anchor roofs against hurricane wind uplift forces, the anchorage methods can be used to reinforce buildings to withstand other wind forces and seismic accelerations as well.

9 Claims, 4 Drawing Sheets

METHOD OF ROOF REINFORCEMENT AGAINST HURRICANES

THE FIELD OF THE INVENTION

The present invention relates to a method for protecting buildings against dynamic forces, such as wind or seismic forces, more particularly to a method for anchoring roofs to underlying walls and other building components primarily by utilizing the in-plane strength of the covering "skins" of such components.

BACKGROUND OF THE INVENTION

The vast number of buildings now built in highly exposed regions and the apparently increasing frequency of category 4 and 5 hurricanes all portend more widespread destruction of houses and other buildings. Much of the destruction is needless. The loss of roofs in particular, with collateral damage to life and property can be preventable.

Many houses and other small buildings in the Caribbean and US "Hurricane Belt" can lose their roofs to category 3 and 4 storms; much of such stock in the U.S. part of that Belt might be little better built. Weaknesses are common in the tie-down of roof structure to the walls below, and are also found in the inadequacy of the roof framing itself to withstand hurricane uplift forces without breaking.

Several regions now require resistance to category 5 storms for new construction, and indeed it need not be unduly costly to incorporate such resistance during construction. Engineers and builders have established the efficacy of fastening roof structure to exterior wall structure by means of steel straps and the like, which is readily and economically done during construction while the structural members are accessible. Such fastenings are described in more than a dozen U.S. patents, for example in U.S. Pat. No. 4,714,372 entitled HURRICANE TIE, issued to Commins on Dec. 22, 1987, and in U.S. Pat. No. 5,560,156 entitled HURRICANE TIE-DOWN, issued to McDonald on Oct. 1, 1996.

There are millions of houses and other low-rise buildings completed without such fastenings or other adequate reinforcement, and the job of "retrofitting" such buildings with steel strap or such devices intended for new construction tends to be disruptive and expensive, even perilous, because trim, soffits, claddings and sheathings must firstly be removed, often working by ladder from the exterior of the building, to access and secure the structural components, after which the whole must be "made good". Nevertheless this is the normally recommended approach to such retrofit, apparently based on the notion that roof structural members must be secured directly to wall structural members in order to develop the necessary anchorage of the roof. Methods and apparatus intended for less disruptive retrofitting work are described in several U.S. patents, for example in U.S. Pat. No. 5,319,896 entitled APPARATUS AND METHOD FOR SECURING BUILDING DURING HIGH WIND CONDITIONS, issued to Winger on Jun. 14, 1994, U.S. Pat. No. 5,570,545 entitled APPARATUS FOR HOLDING A ROOF ON A BUILDING DURING HIGH WINDS, issued to Adams on Nov. 5, 1996, and U.S. Pat. No. 5,623,788 entitled ROOF ANCHORING APPARATUS, issued to Bimberg, Uwe and Bimberg, Oliver on Apr. 29, 1997. Several such retrofit measures are essentially cable or strap arrangements or nets that must be skillfully applied to or over the roof each time a storm is anticipated and removed and safely stored after it's over; others have the advantage of remaining in place as permanent reinforcements but their initial installation is relatively disruptive and costly, and even hazardous in that ladder access is needed as mentioned. Existing buildings are begging for lower cost means of "adding strength just where needed". There is a need for providing a more efficient and less expensive method for protecting buildings, particularly existing buildings and more particularly their roofs, against hurricane force winds.

SUMMARY OF THE INVENTION

It is one object of the present invention to provide a retrofitting method for tying roof structures to suitable walls or other building components below the roof structures to enable the roof structures to remain in place in windstormns.

It is another object of the present invention to provide a retrofitting method to strengthen or support roof structural components themselves to help them withstand windstorm forces without breaking.

It is a further object of the present invention to provide a relatively inexpensive retrofitting method for improving building resistance to windstorms.

It is a still further object of the present invention to provide a retrofitting method for improving building resistance to windstorms entailing relatively little disruption of building or occupants.

It is a still further object of the present invention to allow essentially all work to be done safely within the confines of the building while improving building resistance to dynamic forces such as wind or seismic forces.

In general terms there is provided a method for reinforcement of an existing roof structure comprising steps of placing an anchor assembly into a cavity of an existing wall and securing the anchor assembly to the wall coverings enclosing the cavity around the anchorage area, and then tying the anchor assembly to the existing roof structure.

In accordance with one embodiment of the present invention an anchor assembly is inserted into a cavity of a wall underlying a roof structure, the anchor assembly having one or more strong anchor plates extending horizontally across a large portion of the cavity width and thickness, and being attached to cables or other tension members extending upward into the roof space; the anchor plates are made fast within the cavity of the underlying wall by the injection or pouring into the wall cavity of a hardening liquid "plug" located to embed and press down upon the upper surface of the anchor plates while strongly adhering to the immediate internal surfaces defining the cavity; and the upper portions of the cables or other tension members are secured to the roof structure in order to hold it down against wind uplift forces.

With respect to another aspect of the invention, a beam or beams are provided to allow the roof to be held down in areas distant from the anchors where the anchors must be spaced widely apart due to the position of suitable underlying walls, said beams normally being installed horizontally within the roof space running transversely to the trusses or rafters and over the anchor points, and being supported (held down) at each anchor point by the aforementioned cables, straps or other tension devices which extend into the roof space; these beams in turn being secured to the roof structure at suitable intervals to hold it down to the underlying components.

With respect to a further aspect of the invention, a roof framing member which is itself weak is tied by strap or other tension tie or strut connecting a relatively central area of the member to an anchor or an anchored beam so that the member is supported against wind uplift forces or "flutter"

force reversals which might otherwise cause it to fatigue and fail in bending or shear.

With respect to a still further aspect of the invention, a method for reinforcement of existing building structures comprises the steps of: inserting a first anchor assembly into a cavity in a first partition component of the existing building structures; locking the anchor in the cavity and securing the anchor assembly in tension to a building structure adjacent to the first partition component.

It is preferred to insert anchor assemblies into cavities in adjacent partition components which abut each other and to tie the anchor assemblies together so that the building structures are strengthened against tension, compression or shear, resulting from wind or seismic forces.

The method provided according to the invention enables permanent reinforcement of buildings against not only windstorms, but also other dynamic forces, such as seismic forces if it is desired. All work can be done indoors and with a minimum disruption of buildings or people. Other features and advantages will be better understood with reference to the preferred embodiment described below.

BRIEF DESCRIPTION OF THE DRAWINGS

Having thus generally described the nature of the invention, reference will now be made to the accompanying drawings, showing by way of illustration a preferred embodiment thereof, in which.

In all drawings, like numbers denote like objects.

DETAILED DESCRIPTION OF THE PREFERRED EMBODIMENT

For greater certainty the terms of "roof", "building", "house" and "underlying wall" which are used throughout the specification and appended claims are defined as follows. "Roof" refers to the whole roof structure, normally encompassing the roof-ceiling structure, except where individual components of a roof are identified. "Building" or "house" refer generally to a small low-rise building having a roof space between the uppermost ceiling and the underside of the roof deep enough to allow a person to work within it. "Underlying wall" or "wall underlying" refers to a wall immediately below the ceiling underlying the roof structure, or to any suitably strong building component similarly positioned and generally having vertical planes clad with sheathings, coverings or finishing materials, eg. cross walls or the enclosures of stairwells, closets, or bathrooms.

Figure 1:
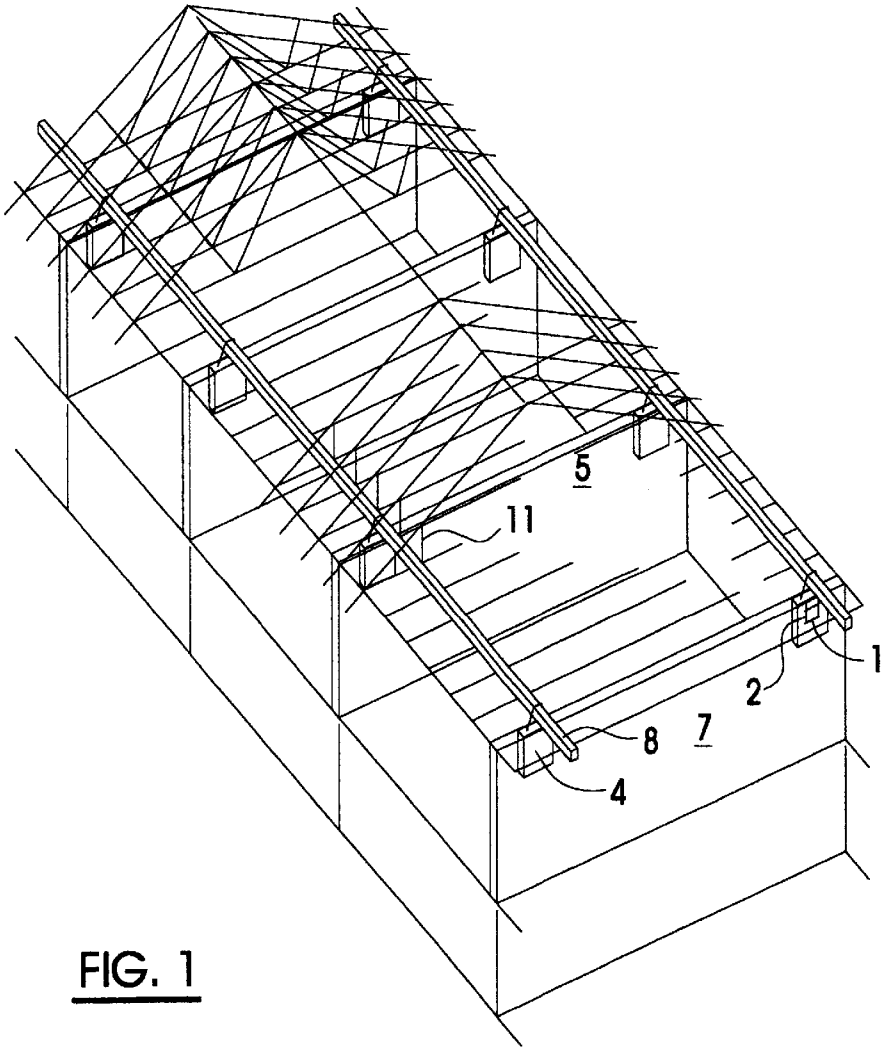
FIG. 1 is a perspective sketch showing cross wall or partition structures within a simple, fairly common building structure incorporating the invention, in which anchors are inserted into cross wall cavities and beams assembled in the roof space to hold down and strengthen the whole roof structure against uplift forces.

FIG. 1 shows the usage of cross walls as anchorages in a low-rise building at locations firstly dictated by the wall locations, positioning the anchors at points thereupon most suited to holding down the roof structure where most needed. The anchoring points are normally selected as close to the exterior walls upon which the roof structure is supported as working room in the roof space will allow. Beams and ties are used to hold down the roof structure at points between the anchorages.

Figure 2:
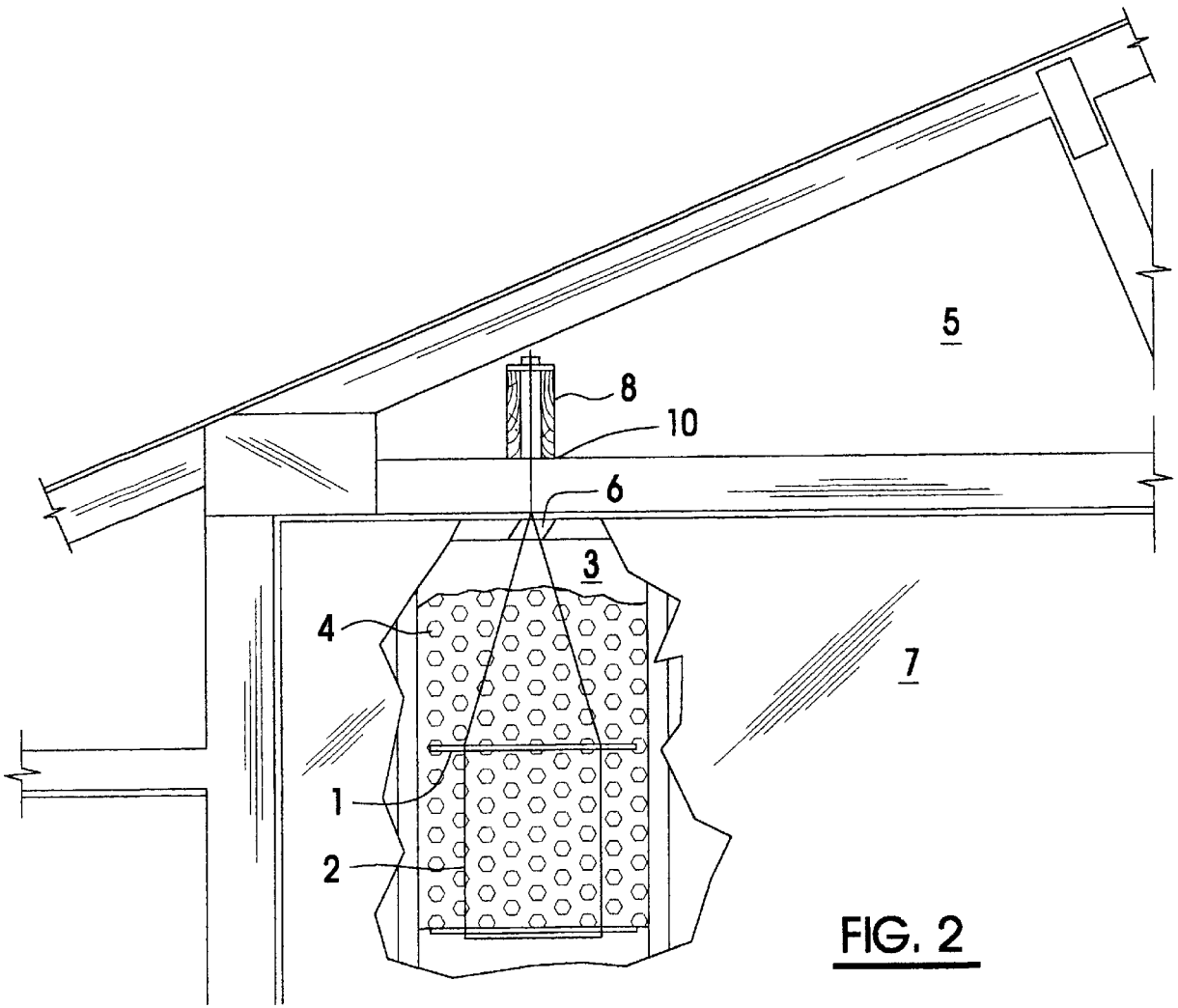
FIG. 2 is an elevational cross-sectional view of a portion of such a building according to one embodiment of the invention showing a truss type example of roof framing and a framed cross wall under a roof space, with part of the cross wall's near-side skin cut away to show a cavity with an anchor and cable assembly holding down a beam in the roof space.
Figure 3:
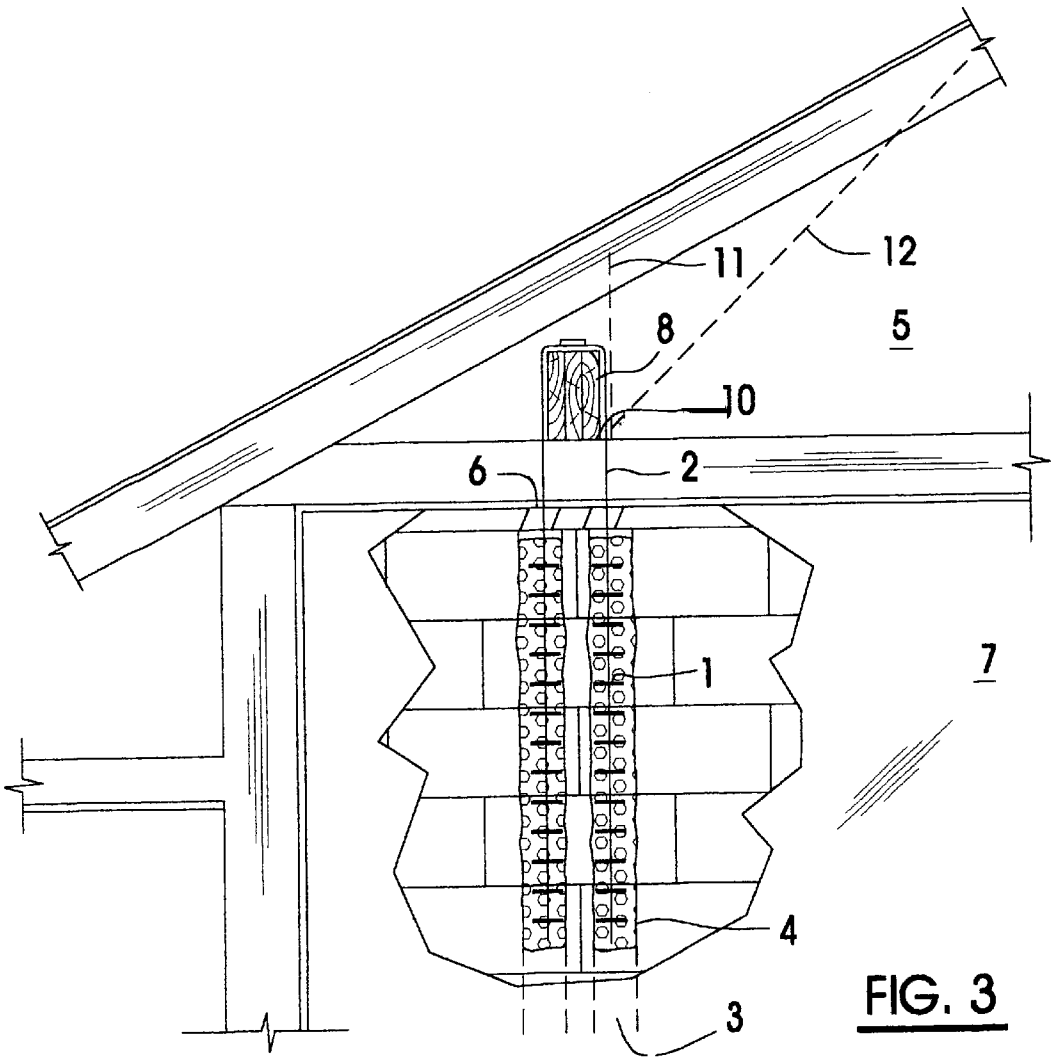
FIG. 3 is a similar elevational cross-sectional view according to another embodiment of the invention, showing a rafter type of roof framing and the inside of a concrete block type of cross wall, showing a hidden anchorage assembly that suits that wall condition.

Referring to FIGS. 1, 2 and 3 in detail, anchor plates 1 are suspended from cables 2 and inserted into wall cavities 3 to comprise "anchor assemblies" therein. The anchor plates 1 are strongly locked in position by injecting or pouring a hardening liquid or semi-liquid which forms "plugs" 4, adhering to the interior surfaces of the walls' coverings and the bounding frames or other internal structure which define the cavities 3. The cables 2 extend upward into the roof space 5 through holes 6 drilled or cut through the tops of the walls 7, through which holes 6 the anchor assemblies have been inserted into the cavities and through which the hardening, adhering liquid or semi-liquid is normally injected or poured. The holes 6 are shown cut or drilled at a slant simply because that is the most convenient way of drilling, and facilitating insertion of the anchor assemblies, when working within such cramped quarters. In the roof space 5, the cables 2 are secured to roof frames or to the beam 8, and tightened down using standard tightening gear, thus anchoring the roof directly to the anchor or to the beam 8 so that the roof structures can in turn be tied down by the beam.

It is noted that although the anchor assembly shown in FIG. 3 is secured to the interior surfaces of the concrete blocks rather than the wall coverings, the concrete blocks nevertheless are normally held together primarily by the wall coverings at both sides. Therefore, as a matter of fact, the in-plane strength of the wall coverings is normally the primary strength utilized to hold down the roof structures against uplift forces.

Figure 4:
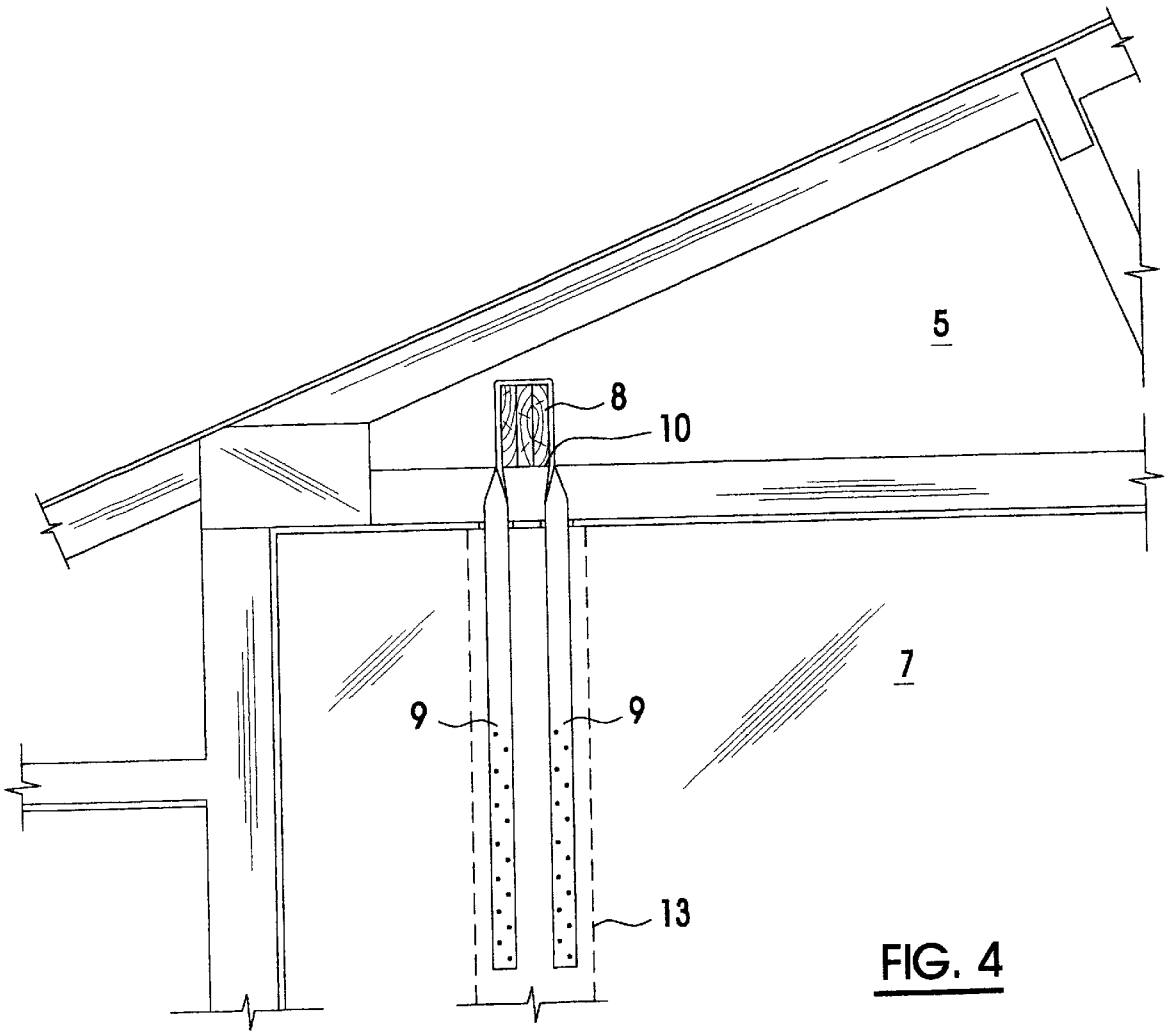
FIG. 4 is a similar elevational cross-sectional view according to a further embodiment of the invention showing a cross wall having no cavity, or none readily accessible, and an anchor deployed on a visible surface of the wall.

In FIG. 4, the wall 7 is assumed to have no suitable or accessible cavities. The embodiment of the invention in this case comprises the provision of anchorage located suitably as before, but made fast to or through the surface of the underlying wall instead of within the walls. The anchor assembly is now comprised of strong straps or other tension members 9 running down the wall surfaces as shown and extending up through holes in the ceiling into the roof space 5, wherein they secure the roof structure directly or by means of securing the beam 8. The lower portions of the straps 9 are fastened into the wall by standard means of nails, screws or rivets, in a location and manner where a sufficiently large portion of the wall coverings or underlying structure or both is put into play to provide the required resistance. Alternatively, a plate may be provided to secure a large portion of the wall coverings, and straps or cables are securely attached to the plate and extend up through the ceiling to secure the roof structure on the beam 8.

The surface strap anchor 9 is an alternative to the cavity anchor assembly 1, 2 even where the walls do have accessible cavities; the drawbacks are that the straps 9 are visible, involve work within the indoor space, and call for final make-good such as a vertical trim piece 13 over the indoor portion of the straps. An advantage of the surface straps 9 is their availability for easy inspection, and no random holes need be drilled to check the cavity positions, which may normally be necessary in the case of concrete block walls as shown in FIG. 3.

In the general case of trussed roofs, as in FIGS. 2 and 4, the beam 8 sits on top of the lower chords of the trusses 10 (near a node, for proper load transfer) and thereby, usually in concert with a similar beam and anchors placed similarly near the other end of the trusses, holds down the whole roof with no need for further ties or fasteners.

In the general case of rafter framing, as in FIG. 3, the beam 8 sits on top of the ceiling joists, and, especially where the rafters are not securely spiked to the ends of the joists, steel straps 11 or other suitable ties are installed to fasten the rafters down to the beam 8.

The roof's inadequacies are not limited only to tie-down strength at the eaves and FIG. 3 illustrates the not uncommon case where the rafters themselves lack bending strength to resist anticipated wind forces. Ties 12 can connect the center-span zone of each rafter to the beam 8 and the whole roof structure can in such manner be strengthened against breaking upwards when loaded by wind uplift forces. In such cases the anchor points and beams might well be located more to the middle of the roof plan, away from the exterior wall line. The ties 12 can be rigid struts that can take compression as well as tension loads, thereby supporting the weak framing member from "flutter" during load reversals.

In another embodiment, the anchor assembly is placed in a cavity in the respective adjacent partition components which abut each other. The anchor assemblies in the respective cavities are locked by introducing liquid or semi-liquid masses into the respective cavities immediately around the respective anchor assemblies. The liquid or semi-liquid masses harden to form a plug imbedding the anchor assembly therein and adhering to surfaces bounding the cavity. The anchor assemblies anchored in the respective adjacent partition components are then tied together. Thus, the existing building structures are strengthened against tension, compression or shear, resulting from wind or seismic forces.

In the concerning design, anchor assemblies 1, 2 and 9 and straps 11 and 12 may be formed of galvanized steel; the plugs of 4, of expanding polyurethane foam or other such polymeric material; and the beams 8, of wood or steel pieces of perhaps three meter maximum length. Such a length allows the introduction of the pieces into the roof space 5 through "attic hatches" which, because of fire codes, are almost universally present. Multi-piece beam sections such as the three-piece one shown allow the beams 8 to be made continuous across the anchor points, thereby providing desired strength and stiffness with minimum material. Especially where the wall cavities are restricted, as in the concrete block example of FIG. 3, the injected plug 4 may be of a higher density polyurethane or other expansive, adhering materials. The hidden cavity work may be inspected using an optical fibrescope, say, as established in the prior arts for building retrofit work.

The maximum size of the anchor plates 1 is determined by the dimensions of the wall cavities 3, leaving room to insert injection nozzles or the like to inject the hardening liquid plug 4; the number of anchor plates in each anchor assembly is determined by that size (bearing area) and the total bearing area required, which is a function of the bearing strength and adhesive strength of the plug material 4 and the total uplift force each anchor must resist, ie. its "design load". Analytical experience shows anchor assemblies as illustrated can readily be sized and detailed for design loads of 5 to 6 metric tonnes, for example, within or on normal non-loadbearing walls; such design loads being in the range encountered in typical building configurations such as in FIG. 1. Further, the anchor assembly's elasticity or deformability under dynamic load can be designed to relate to that of the roof's existing tie-down provisions, so that the uplift loads will be shared between the added anchors and the existing provisions in an approximately predictable manner, thereby allowing economy of design of the anchor assemblies. Of course, a test program could furnish more knowledge about the properties of the anchor assemblies in various wall constructions, and thus allow finer design, ie., with a reduced load factor or "factor of ignorance", and thus still better economy in individual and mass applications; but the engineering can be done soundly and rather economically with present knowledge of loads and material properties.

Changes and modifications to the embodiments of the invention described above may be made without departing from the spirit and scope of the invention which are intended to be limited only by the scope of the appended claims.

I claim:

1. A method for reinforcement of an existing roof structure comprising steps of:.

a) placing an anchor assembly into a cavity in an existing wall;

b) securing the anchor assembly to wall coverings enclosing the cavity around an anchorage area; and c) tying the anchor assembly to the existing roof structure.

2. A method as claimed in claim 1 wherein the securing of the anchor assembly to the wall coverings is achieved by introducing liquid or semi-liquid masses into the cavity immediately around and above the anchor assembly, the liquid or semi-liquid masses hardening to form a plug bearing down on the anchor assembly and strongly adhering to the wall coverings.

3. A method as claimed in claim 1 wherein the securing of the anchor assembly to the wall coverings is achieved by locking the anchor assembly rigidly to existing wall structures bounding the cavity.

4. A method as claimed in claim 3 further comprising a step of introducing liquid or semi-liquid masses into the cavity immediately around and above the anchor assembly, the liquid or semi-liquid masses hardening to form a plug bearing down on the anchor assembly and strongly adhering to the existing wall structures bounding the cavity.

5. A method as claimed in claim 1 further comprising as a step of placing a beam within the roof space, the beam passing over a plurality of roof frames and at least one of the existing walls; and then, completing steps of a, b and c at a conjunction of the beam and the at least one of the existing walls wherein the tying of the anchor assembly to the existing roof structure is achieved by securing the anchor assembly to the beam.

6. A method as claimed in claim 5 comprising a step of placing a tie member to interconnect an upper component of the roof structure and the beam so that the upper component of the roof structure is reinforced against load forces induced by winds.

7. A method as claimed in claim 6 wherein the tie member comprises a rigid strut adapted for bearing both compression and tension loads from the upper component of the roof structure.

8. A method for reinforcement of existing building structures against dynamic forces comprising steps of:

a) inserting an anchor assembly into a cavity in a partition component of the existing building structures;

b) locking the anchor assembly in the cavity by introducing liquid or semi-liquid masses into the cavity immediately around the anchor assembly, the liquid or semi-liquid masses hardening to form a plug imbedding the anchor assembly therein and adhering to surfaces bounding the cavity; and c) securing the anchor assembly in tension to a building structure adjacent to the first partition component.

9. A method as claimed in claim 1 further comprising a step of, within the roof space, forming an opening through a top of the existing wall for providing an access from the roof space to the cavity in the existing wall.

* * * * *